US008309904B2

(12) United States Patent
De Coi et al.

(10) Patent No.: US 8,309,904 B2
(45) Date of Patent: Nov. 13, 2012

(54) SAFETY SYSTEM FOR SAFEGUARDING A MOVING, GUIDED MOTION ELEMENT HAVING SWITCHABLE OBJECT DETECTION DEVICES

(75) Inventors: Beat De Coi, Sargans (CH); Christian Signer, Malans (CH); Markus Menzi, Filzbach (CH); René Hug, Melz (CH)

(73) Assignee: Cedes AG, Landquart (CH)

( * ) Notice: Subject to any disclaimer, the term of this patent is extended or adjusted under 35 U.S.C. 154(b) by 149 days.

(21) Appl. No.: 12/836,838

(22) Filed: Jul. 15, 2010

(65) Prior Publication Data

US 2010/0325959 A1 Dec. 30, 2010

Related U.S. Application Data

(63) Continuation of applicationNo. PCT/EP2009/000276, filed on Jan. 16, 2009.

(30) Foreign Application Priority Data

| | | |
|---|---|---|
| Jan. 16, 2008 | (DE) | 10 2008 004 760 |
| Mar. 12, 2008 | (DE) | 10 2008 013 844 |
| May 13, 2008 | (DE) | 10 2008 023 294 |

(51) Int. Cl.
*H01J 40/14* (2006.01)

(52) U.S. Cl. ..... 250/222.1; 250/559.4; 340/555

(58) Field of Classification Search ..... 250/221, 250/222.1, 559.4; 340/555–557; 348/143, 348/152; 382/103, 107
See application file for complete search history.

(56) References Cited

U.S. PATENT DOCUMENTS

| | | | | |
|---|---|---|---|---|
| 4,750,591 | A * | 6/1988 | Coste et al. | 187/391 |
| 6,218,940 | B1 | 4/2001 | Rejc et al. | |
| 6,547,042 | B1 * | 4/2003 | Collins | 187/317 |

FOREIGN PATENT DOCUMENTS

EP 0 902 157 B1 3/2003

* cited by examiner

*Primary Examiner* — Francis M Legasse, Jr.
(74) *Attorney, Agent, or Firm* — Burr & Brown

(57) ABSTRACT

A safety system for safeguarding a moving, guided motion element against unwanted collisions with an object located on a motion path in the direction of motion of the motion element. The safety system includes an object-detection device for detecting an object in an area of the motion element. The object-detection device can be blocked with respect to object detection by a motion of the motion element, and has an electronic unit with which the motion of the motion element can be controlled and which is configured to assign a blocked state to the object-detection device when the motion element approaches in the blocked state an object or motion element will not trigger a safety mode and when a shut-off signal coming from the motion element is detected, at least part of the object-detection device is transferred into the blocked state.

9 Claims, 4 Drawing Sheets

SAFETY SYSTEM FOR SAFEGUARDING A MOVING, GUIDED MOTION ELEMENT HAVING SWITCHABLE OBJECT DETECTION DEVICES

CROSS REFERENCE TO RELATED APPLICATIONS

This application is a continuation of International Application No. PCT/EP2009/000276 filed Jan. 16, 2009, which designated the United States, and claims the benefit under 35 USC §119(a)-(d) of German Application Nos. 10 2008 004 760.0 filed Jan. 16, 2008, 10 2008 013 844.4 filed Mar. 12, 2008 and 10 2008 023 294.7 filed May 13, 2008, the entireties of which are incorporated herein by reference.

FIELD OF THE INVENTION

The invention relates to safety system for safeguarding a moving, in particular vertically moving, guided motion element against unwanted collisions.

BACKGROUND OF THE INVENTION

European Patent No. 0 902 157 B1 discloses safeguarding doors with a light curtain which is mounted in the plane of motion of a door. So that the door is not detected as an object, monitoring beams of the light curtain are blocked with respect to object detection by, in each case, a monitoring beam lying behind in the direction of motion of the door, before a front edge of the door meets the respective monitoring beam. In this way, the monitoring beams of the light curtain are successively no longer available for object detection during a closing motion of the door.

However, in such a configuration it is conceivable that an object which is to be detected is incorrectly interpreted as an approaching door and could therefore bring about undesired blocking of monitoring beams.

SUMMARY OF THE INVENTION

The invention is based on the object of making available a safety system of the type described above, which safety system can be blocked comparatively more reliably with respect to object detection as a function of a motion of a motion element.

The invention is based on a safety system for safeguarding a moving, guided motion element, for example, a door or a door element, against unwanted collisions with an object located on a motion path in the direction of motion of the motion element. The safety system comprises an object-detection device for detecting an object in an area of the motion element, which object-detection device can be blocked with respect to object detection by a motion of the motion element, and has an electronic unit with which the motion of the motion element can be controlled and which is configured to assign a blocked state to the object-detection device when the motion element approaches, in which blocked state an object or motion element does not trigger a safety mode. For this purpose, a shut-off mechanism is provided which, when a shut-off signal coming from the motion element is detected, transfers at least part of the object-detection device into the blocked state. The core of the invention is then the fact that the shut-off mechanism comprises a transmitting element for a shut-off signal which is either seated directly on the motion element or is tuned to a separate reflector for electromagnetic radiation, in particular an optical reflector on the motion element, in such a way that a signal of the transmitting element can be received by a receiver of the shut-off mechanism only in a predefined motion area of the reflector on the motion element. This procedure makes it possible to avoid a reflection of an object being interpreted as a shut-off signal and the object-detection device or at least part thereof therefore being incorrectly shut off.

The safety system according to the invention can be used, in particular, in the case of rolling doors or gates or doors, for example in sliding doors such as in extracts. Further application areas may be in the field of machines, for example, presses.

Since it is necessary for a signal from the motion element to be received directly, or at least via the separate optical reflector, in order to block at least part of the object-detection device, it is possible to ensure that objects in the door/gate area cannot trigger such blocking since such objects normally do not emit corresponding signals.

In contrast to the configuration according to EP 0 902 157 B1, blocking does not take place on the basis of interruption of a beam but rather as a result of the detection of a specific signal coming from the door element, which generally differs from signal reflections at objects. This makes the blocking process significantly more reliable.

If appropriate, the object-detection device is not entirely shut off by the shut-off mechanism.

In one particularly preferred embodiment of the invention, the object-detection detectors comprises a curtain composed of a multiplicity of object-detection means which are arranged successively in the direction of motion of the motion element, for example, photoelectric barriers or photoelectric sensors. When shutting off occurs as a result of the approaching motion element, the object-detection detector which is closest in front of a front edge of the motion element is blocked with respect to object detection.

Furthermore, it is particularly preferred if the shut-off mechanism is configured to evaluate a shut-off signal as such only if said shut-off signal comes from the motion element in a predefined time section during the motion of the motion element. As a result, the reliability of shutting off is increased even further. This is because the probability that a signal firstly meets the conditions to be basically evaluated as a shut-off signal and secondly also occurs in a predicted time window is highly improbable. The predicted time window can be determined, for example, by virtue of the fact that owing to a known speed of the motion element and a known geometric arrangement of the shut-off mechanism, it is possible to predict at what time the motion element must appear at a predefined location of the shut-off mechanism.

This significantly increases the probability that a blocked state is correctly assigned to the object-detection device when a motion element, for example door element, is approaching, in which blocked state an object or the motion element does not trigger, at the object-detection device, a safety mode, which for example, stops and/or reverses the motion element.

A reflector in the signal path of the shut-off mechanism is advantageous because a reflector reflects light much better than an object which is usually to be detected, with the result that it is possible to operate with comparatively less light power at the shut-off mechanism. Furthermore, this permits a misinterpretation of a reflection from an object which is to be detected to be ruled out if only light which is directed and/or conditioned in a defined fashion is used for the evaluation. The reflector at the motion element can have a pattern. For example, the pattern must be detected in order to generate a shut-off signal. This can be done, for example, by multiple scanning. The mounting of a reflector on the door element make it possible to dispense with elements which generate a signal at the motion element, and generally electronic components. The system therefore becomes more robust since electronic components do not have to withstand vibrations of a door element because they are not mounted on the door. Furthermore it is not necessary to conduct a power supply to the door element. However, it is conceivable to mount, for example, a magnet, in particular a permanent magnet, on the motion element. The magnet will not have the above-described disadvantages even though it is mounted on the motion element. The magnetic field of the permanent magnet can then be evaluated as a shut-off signal.

The shut-off signal coming from the motion element, for example a door, a gate or some other component which is guided in a moving fashion can be a sound signal and/or light signal and/or of an electromagnetic or magnetic nature. It is also possible for polarized light to be used, which increases the resistance against interference.

It is conceivable, for example, that emitted electromagnetic radiation, for example, light, is provided with a predefined property by means of a modulator, wherein the modulated light is tuned to an analyzer which is seated in front of the receiver, in such a way that only the changed, modulated light can be received. This procedure considerably increases the reliability of the detection of the signals. For example, light is changed in a predefined way by means of a pole filter or a delay panel. The receiver is configured in such a way that it can only receive the changed light. For example, the emitted light is polarized linearly, with a reflector changing the polarization properties in such a way that light which is polarized in a circular fashion impinges on the receiver. The light which is polarized in a circular fashion can be evaluated at the receiver.

Through a corresponding selection of the type of signal as a function of the location of the sliding door it is also possible to rule out misinterpretations occurring during the blocking of object detectors of the object-detection device because, for example, a reflection from an object is incorrectly interpreted by a sensor of the object detector.

In one particularly preferred embodiment of the invention, the shut-off mechanism comprises a transmitter or receiver which forms, together with a receiver or transmitter of the object-detection device, the shut-off mechanism in the region of a guide bar of the motion element. This measure allows the safety system to be configured cost-effectively since existing elements of the object-detection device are used at the same time for the shut-off mechanism. For example, receivers and their evaluation electronics are comparatively expensive. Accordingly, it is advantageous that the shut-off mechanism uses the existing receivers of the object-detection device but, if appropriate, have additional transmitters so that a signal can be directed via the motion element, that is to say coming from the motion element, to the existing receiver using the transmitters, and can be evaluated at said receiver in order to bring about blocking of at least part of the object-detection device.

In this context, a transmitter does not have to be assigned to each object detector of the object-detection device. It is conceivable for a transmitter to cooperate with a plurality of receivers of the object detectors, for example, object detectors are switched to a passive state in blocks or blocked or entirely shut off. It is also conceivable for a transmitter of the shut-off mechanism to be assigned only to individual receivers of the object detectors, with further object detectors, which follow in particular in the closing direction of the motion element, without an assigned transmitter being shut down by means of an algorithm, for example, by means of a speed calculation.

In a further particularly advantageous embodiment of the invention, the object detectors are photoelectric barriers and are therefore not based on the need for a back reflection from an object which is to be detected. It is also completely conceivable to use a photoelectric barrier beam which is defected via mirror means. In this way, objects can be more reliably detected because the quality, in particular the surface quality, of the objects does not significantly influence the detection.

It is also conceivable to form, on the motion element, an electronic unit which is capable of emitting a signal for the shut-off mechanism. For example, a transmitter for infrared light is used which is operated, for example, by means of a battery. However, a supply via cable is also possible. In contrast, a wireless transmission of energy can take place, for example, by means of induction via an alternating magnetic field whenever the motion element is closed. It is therefore possible to charge an energy buffer, for example, an accumulator in the transmitter on the motion element, in a wireless fashion. The accumulator can also be supplied in a wireless fashion with energy via electromagnetic radiation.

In another preferred embodiment of the invention, the shut-off mechanism is configured to detect a completely closed state of the motion element, for example, of a door element. It is possible to evaluate, for example, in the closed position of the door element, a signal from the door element which has to be continuously received in this position. The detected closed position can be made available to a door controller.

In this context, it is also preferred if an interface is provided in order to output or read in the current position of the motion element. If the possibility arises of transmitting the end position of the motion element to the controller, it is possible to check, for example, whether the motion element is behaving correctly. For example, photoelectric barriers of the object detectors should "not be able to see" one another in the end position. If, for example, a door is pushed out of the envisaged motion path through the force of the wind, which cannot be ruled out in the case of flexible rolling gates, a corresponding signal, for example, a stop signal, can be transmitted to the controller.

Basically, the object detectors, for example, photoelectric barriers, must be arranged non-equidistantly along the motion path of the motion element. For example, the photoelectric barrier density just in front of the end position of the motion element must be greater than in the remaining area. For example, in the end area, for example, floor area, a distance between the photoelectric barriers of 5 cm must be implemented, and in the remaining area a distance of 20 cm. It is therefore possible for relatively small objects to still be reliably detected, in particular in the floor area of a door. However, overall this removes the need to implement a large sensor density over the entire motion height of the motion element.

Furthermore, it is advantageous if elements of the shut-off mechanism which are mounted on the motion element are at a predefined distance from the front edge. This is because the front edge of motion elements, for example, door elements, is generally not suitable for mounting objects. It is usually soft in order, on the one hand, to be able to satisfactorily close off a gap between the door element and a floor level, which on the other hand reduces the risk of injury when unwanted collisions occur.

In order that the signals of the object-detection device can be blocked in good time, it is proposed that receivers of the shut-off mechanism are arranged offset with respect to receivers of the object-detection device.

In order to obtain a further improvement in the functional reliability of the safety system, the following measures are conceivable:

a) the angle of aperture of optical systems which are used is selected, in particular, according to a relevant standard;
b) the signal chain is monitored, for example by monitoring the number of object detectors which are active for object detection;
c) switching outputs of the object-detection means are provided, for example, with a test input for carrying out test procedures; and
d) furthermore, online tests can be implemented, in the manner of an ROM check, this being carried out continuously during an operation.

The individual components of the safety system on one side of the motion element do not necessarily have to be accommodated in one structural unit. It is conceivable that, for example, individual sensor pairs or groups of sensors which communicate via a bus are mounted. This permits a greater degree of flexibility to be achieved if the object-detection device and/or shut-off mechanism of the safety system are to be adapted to different structural conditions, in particular relatively small or relatively large monitoring areas.

For the object-detection device and/or shut-off mechanism, it is possible to use a wide variety of technologies of sensor types. Laser scanners, distance sensors such as, for example, time of flight sensors or stereo cameras, photoelectric barriers and reflection photoelectric barriers are conceivable, to name only a selection of the possibilities.

The sensors can then be selected as a function of the performance profile which is required of the respective door element.

BRIEF DESCRIPTION OF THE DRAWINGS

Several exemplary embodiments of the invention are illustrated in the drawings and will be explained below in more detail, including information about further advantages and details.

DETAILED DESCRIPTION OF THE INVENTION

Figure 1:
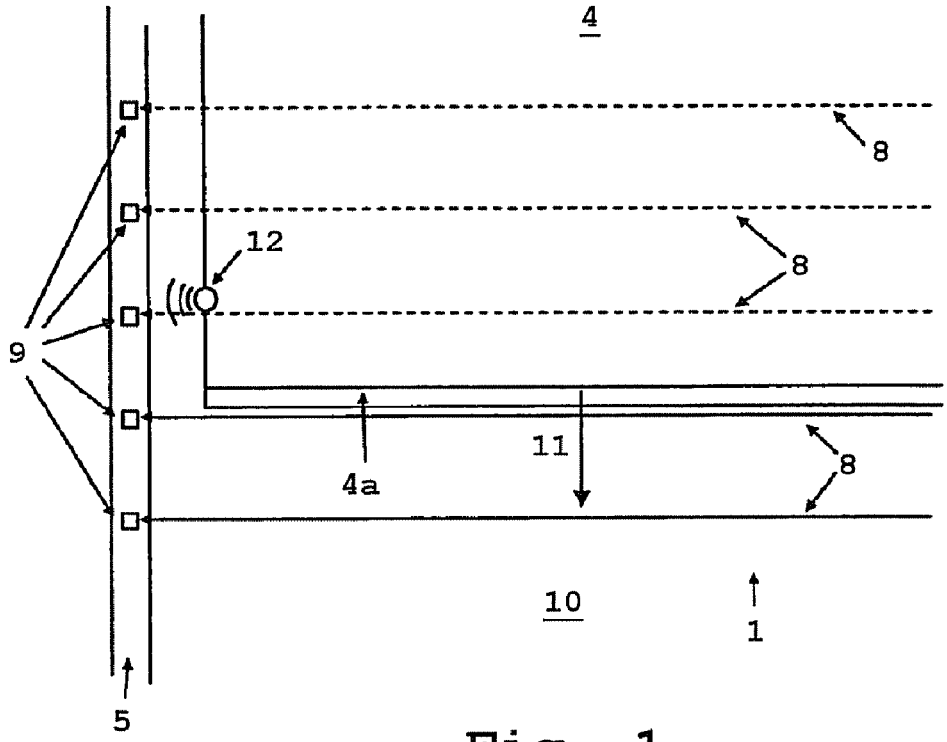
FIGS. 1-3 show a detail of a door element and of a door safety system on one side of the door element in, in each case, a schematic illustration of different configurations of shut-off mechanisms which bring about blocking of monitoring light beams of a photoelectric barrier arrangement for object detection.
Figure 2:
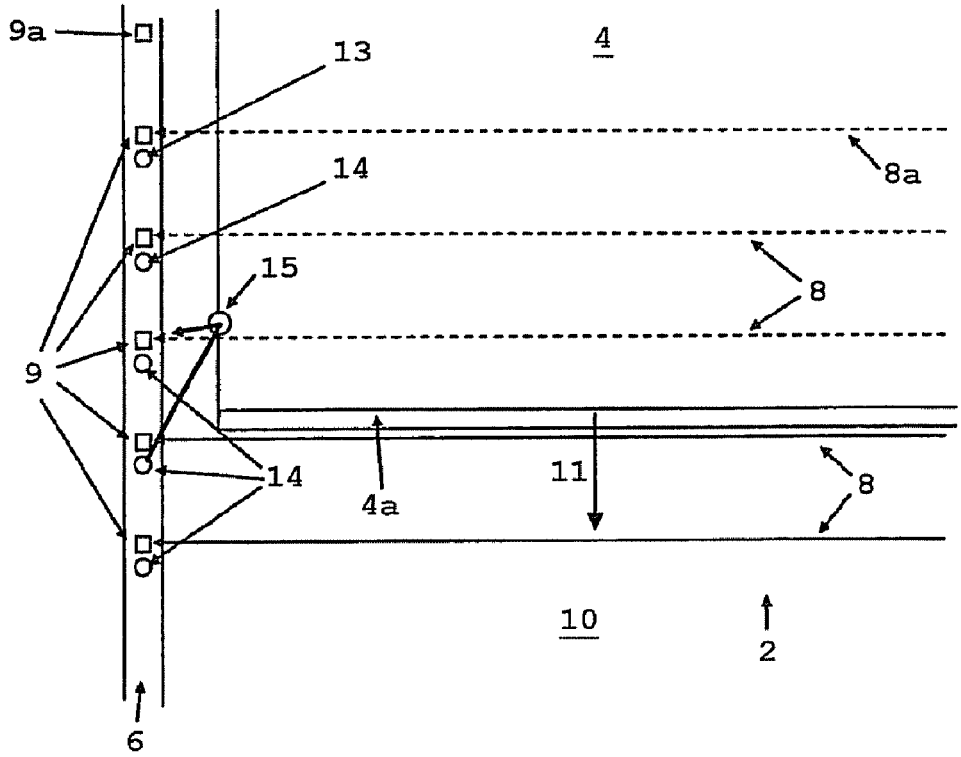
Figure 3:
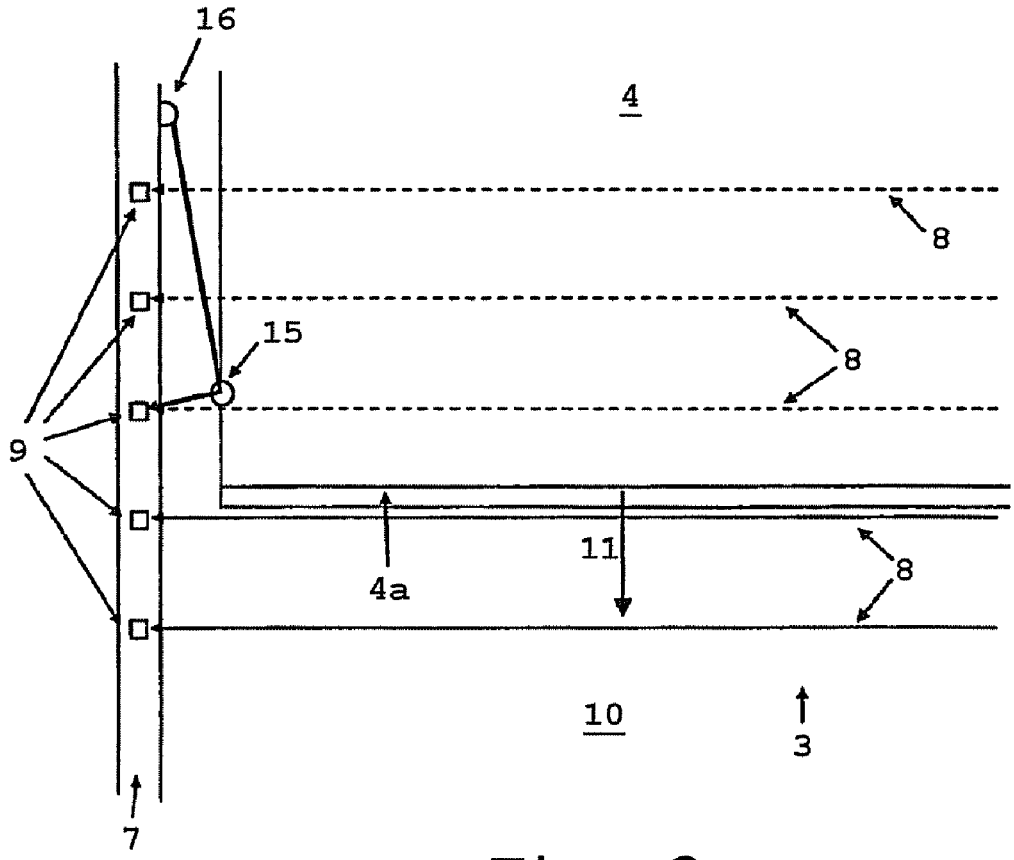

FIGS. 1-3 each show the left-hand side of different door safety systems 1, 2, 3. In each case the left-hand, lower corner of a door element 4 is represented in a schematic form. The door safety systems 1, 2, 3 each comprise, on the left-hand side, a receiver strip 5, 6, 7. The associated transmitters, which emit monitoring light beams 8 to, in each case, one receiver 9, are not illustrated in FIGS. 1-3. The monitoring light beams 8 ensure that when an object enters an area 10 underneath a front edge 4*a* of the door element 4, an interruption in the monitoring light beams 8 causes the door element 4 to stop and, if appropriate, reverse in order to prevent collisions with the object.

However, when the door element 4 moves down it is ensured that the door element 4 does not itself trigger a safety mode because the door has interrupted a monitoring light beam 8. This can be achieved in that, before the respective monitoring light beam 8 is reached by the front edge 4*a* of the door element 4 during a motion of the door element 4 in a direction of motion 11, a respective transmitter/receiver pair for generating the monitoring light beam is placed in a passive state which no longer triggers the safety mode.

In FIGS. 1-3 this takes place in a different way:

In FIG. 1, a transmitter 12 is positioned in the left-hand front area of the door element 4. The transmitter 12 cooperates with receivers (not illustrated) which could basically also be the receivers 9, as a result of which when the door element 4 moves down, the monitoring light beams 8 are successively blocked with respect to object detection. The blocked monitoring light beams are illustrated by dashes in FIGS. 1-3. The transmitter 12 preferably cooperates with the receivers in such a way that before a monitoring light beam 8 is reached by the front edge 4*a* of the door element, a respective receiver detects that the door element is located in this position by means of a signal which is emitted by the transmitter 12, as a result of which the respective receiver/transmitter pairing for the monitoring light beam is placed in a passive state.

Figure 7:
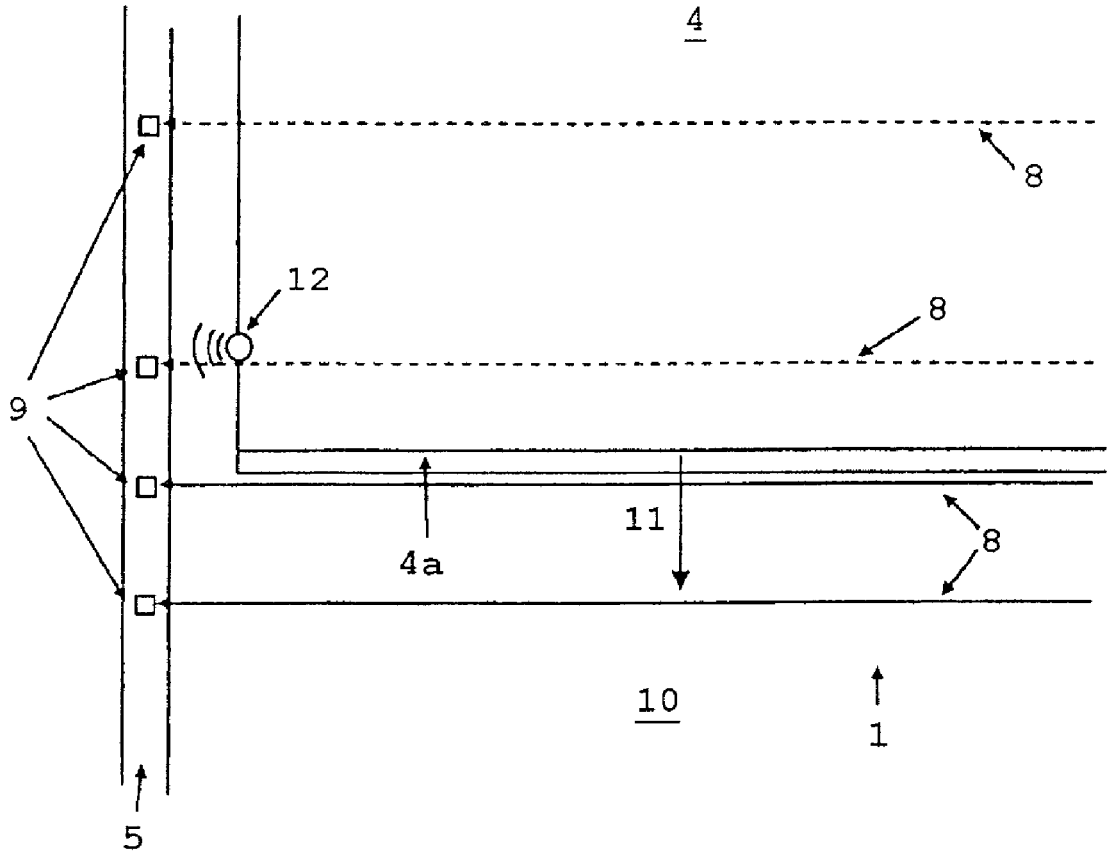
FIG. 7 shows a detail of a door element and a door safety system where the object detectors are arranged non-equidistantly.

The receivers of the shut-off mechanism are preferably arranged with an offset with respect to the receivers for the respective monitoring light beams 8. Further, as shown in FIG. 7, the receivers 9 may be arranged in the direction of the motion element 11 non-equidistantly.

In FIG. 2, the same receivers of the detection means are also used for the shut-off mechanism. In order to permit the first beam 8 also to be shut off in good time, an additional receiver 9*a*, which evaluates light from an additional transmitter 13 in order to block the following monitoring light beam 8*a* in the direction of motion 11 or to place the associated receiver/transmitter pair in a passive state with respect to object evaluation, is provided in FIG. 2. The signal of the additional transmitter 13 is directed to the receiver 9*a* via a reflector 15. The reflector 15 is seated on the door element 4, so that in this way the presence of the door element can be reliably detected. When the door element 4 continues to move in the direction of motion 11, further additional transmitters 14 then cooperate with receivers 9 which are arranged with an offset, in order to respectively maintain the blocking of the monitoring light beams.

In FIG. 3, the shut-off mechanism comprises a single transmitter 16 which reflects, via the reflector 15 mounted on the door element 4, light to receivers 9 which are already present. As soon as a receiver 9 detects a signal coming from the transmitter 16, this receiver 9 and an associated transmitter on the other side of the door are placed in a blocked state with respect to object detection, so that the safety mode is not triggered if the front edge 4*a* interrupts the signal path between this sensor pairing.

Basically it is conceivable that a transponder system is also used for door detection, with a transponder being mounted on the door element. For example, an RFID system can be used with a transponder on the door element. The transponder may be passive, for example, that it does not have its own power supply. If an RFID is used on the motion element, for example, a door, the position of the door can be determined by means of triangulation. For example, an RFID receiver is respectively provided at the upper end and at the lower end of the motion path of the door.

Figure 4:
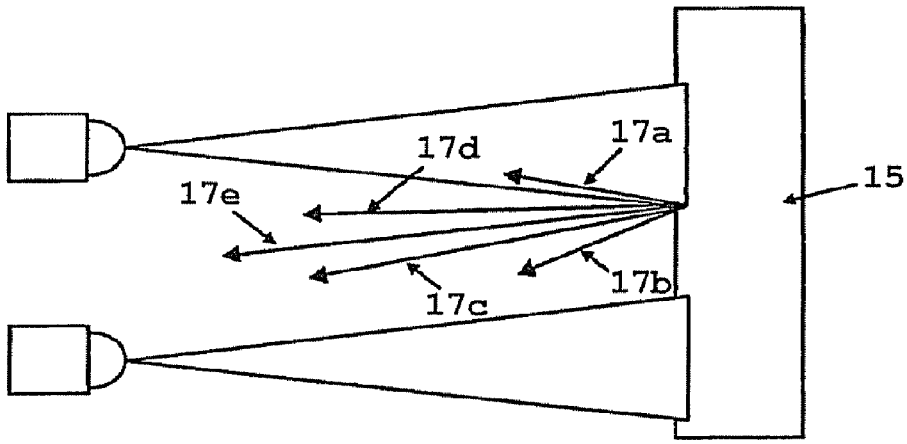
FIGS. 4 and 5 show possibilities of reflectors which are part of a signal path of the shut-off mechanism, in each case in schematic views.

It is important that the signal path with shut-off mechanisms 12, 13, 14, 15, 16 be subjected to as little interference as possible. This may be achieved, for example, by virtue of the fact that a reflector 15, on a door element has such as is illustrated in FIG. 4, only a small reflection lobe, which arrows 17*a*-17*e* are intended to illustrate. This ensures that the possibility of the shutting-off of a beam by means of stray light to the next receiver of the shut-off mechanism is also ruled out in practice.

Figure 5:
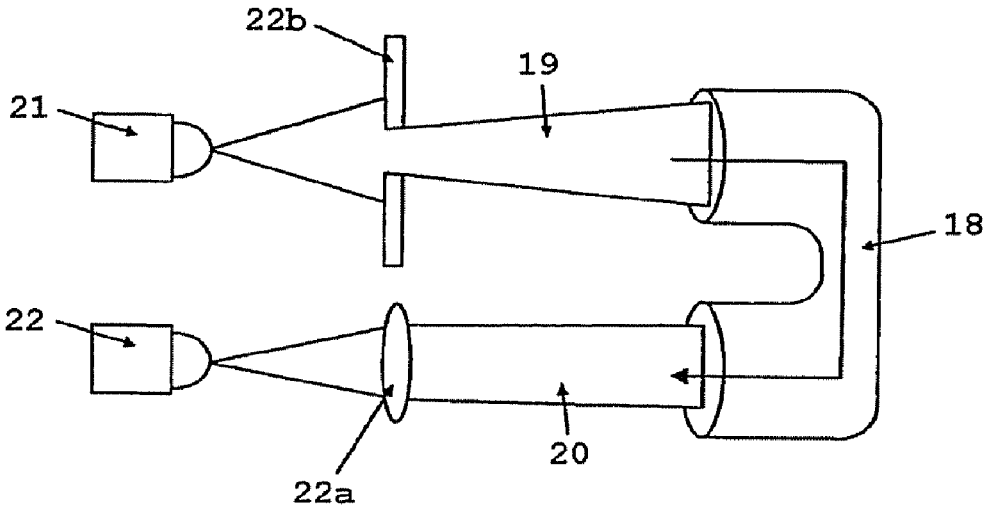

Instead of a reflector 15 which is mounted in a more or less open fashion, it is also possible to use a type of light guide 18 which has a defined reception lobe 19 and a defined transmission lobe 20 on a transmitter 21 or with respect to a receiver 22, so that this is also a means of ensuring that the incorrect interpretation of signals can virtually no longer take place (see FIG. 5). In the signal path it is therefore possible to use, as illustrated in FIG. 5, a collimation device, for example a lens 22*a*, which makes it even more difficult for reflection of light from the transmitter 21 to the receiver 22 to take place and to be interpreted as a shut-off signal. For the further light beam definition it is possible, as is also illustrated in FIG. 5, to provide a diaphragm 22*b*, in particular in the light path from the transmitter 21 to the light guide 18.

In addition, in the light path, a modulator can be arranged after the transmitter 21, and an analyzer can be arranged in front of the receiver 22, and this increases the reliability even further.

Figure 6:
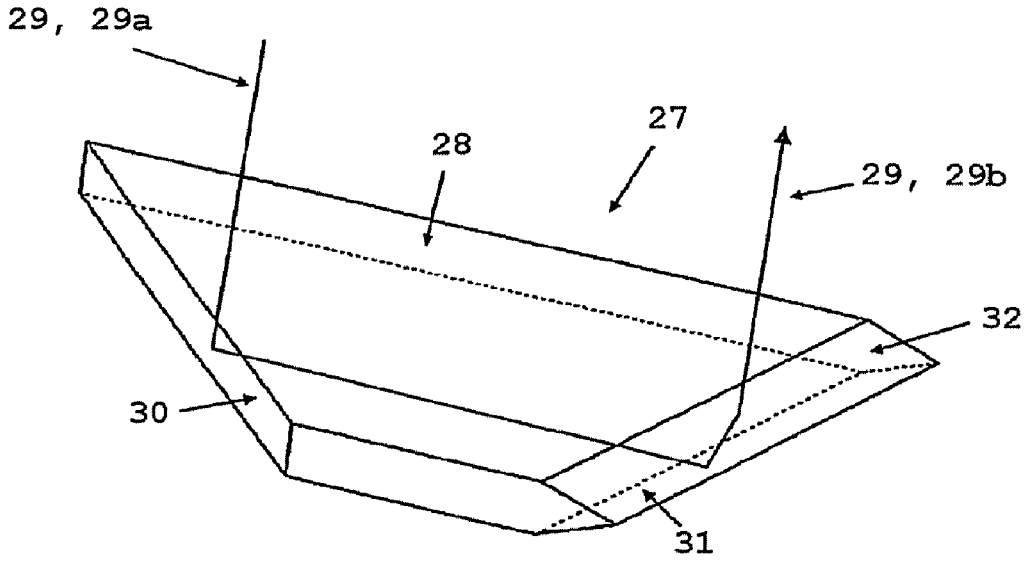
FIG. 6 is a perspective view of a reflector for the shut-off mechanism.

A reflector 27 is illustrated in FIG. 6. The reflector 27 is, for example, a solid multi-plane element made of a translucent, in particular a glass-clear, material. According to FIG. 6, a light beam 29 enters the reflector 27 at, for example, a face 28, and is then reflected there by total reflection at the face 30, and onto the faces 31 and 32 where total reflection also takes place, so that the light beam 29 exits the reflector 27 again via the face 28.

The special feature of this reflector is that an incident light beam 29*a* is offset only by a certain distance compared to the exiting light beam 29*b*. The direction of the incident light beam 29*a* with respect to the exiting light beam 29*b* remains unchanged. If a plurality of such reflectors are arranged one next to the other, light which is emitted, for example, from a dot source, is reflected to an offset point. This reflector can therefore selectively reflect light, for example to a receiver, with the light additionally having a further predefined direction with respect to the desired light intensity.

The reliability of the system can therefore be increased further since it is improbable that incorrect reflections will be interpreted as a shut-off signal which has actually been reflected.

LIST OF REFERENCE NUMERALS

1 Door safety system
2 Door safety system
3 Door safety system
4 Door element
4*a* Front edge
4*b* End side
5 Receiver side
6 Receiver side
7 Receiver side
8 Monitoring light beam
8*a* Monitoring light beam
9 Receiver
9*a* Receiver
10 Area
11 Direction of motion
12 Transmitter
13 Transmitter
14 Transmitter
15 Reflector
16 Transmitter
17*a* Light beams
17*b* Light beams
17*c* Light beams
17*d* Light beams
17*e* Light beams
18 Light guide
19 Transmission lobe
20 Reception lobe
21 Transmitter
22 Receiver
22*a* Lens
22*b* Diaphragm
27 Reflector
28 Face
29 Light beam
29*a* Incident light beam
29*b* Exiting light beam
30 Face
31 Face
32 Face

We claim:

1. A safety system for safeguarding a moving, guided motion element against unwanted collisions with an object located on a motion path in the direction of motion of the motion element, said safety system comprising:

(i) an object-detection device for detecting an object in an area of the motion element, which object-detection device can be blocked with respect to object detection by a motion of the motion element, (ii) an electronic unit with which the motion of the motion element can be controlled and which is configured to assign a blocked state to the object-detection device when the motion element approaches, in which blocked state an object or motion element does not trigger a safety mode, and (iii) a shut-off mechanism which, when a shut-off signal coming from the motion element is detected, transfers at least part of the object-detection device into the blocked state, wherein the shut-off mechanism comprises a transmitting element for a shut-off signal which is either seated directly on the motion element or is tuned to an optical reflector for electromagnetic radiation on the motion element in such a way that a signal of the transmitting element can be received by a receiver of the shut-off mechanism only in a predefined motion area of the reflector on the motion element, wherein the object-detection device comprises a curtain composed of a multiplicity of object detectors which are arranged successively in the direction of motion of the motion element.

2. The system as claimed in claim 1, wherein the safety system is a door/gate/door safety system.

3. The system as claimed in claim 1, wherein the shut-off mechanism is configured to evaluate a shut-off signal as such only if said shut-off signal comes from the motion element in a predefined time section during the motion of the motion element.

4. The system as claimed in claim 1, wherein the shut-off signal is a signal on the basis of at least one of light, sound, electromagnetic radiation and a magnetic field.

5. The system as claimed in claim 1, wherein the shut-off mechanism comprises one of a transmitter and a receiver which forms, together with one of a receiver and transmitter of the object-detection device, respectively, the shut-off mechanism in the region of a guide bar of the motion element.

6. The system as claimed in claim 1, wherein the object-detection device comprises photoelectric barriers.

7. The system as claimed in claim 1, wherein the shut-off mechanism is configured to detect an end position of the motion element.

8. The system as claimed in claim 7, wherein the end position is a completely closed state of the motion element.

9. The system as claimed in claim 1, wherein the object detectors are arranged non-equidistantly in the direction of motion of the motion element.

* * * * *